US011104173B2

(12) United States Patent
Igarashi et al.

(10) Patent No.: US 11,104,173 B2
(45) Date of Patent: Aug. 31, 2021

(54) TRANSFER PAPER

(71) Applicant: MITSUBISHI PAPER MILLS LIMITED, Tokyo (JP)

(72) Inventors: Koji Igarashi, Tokyo (JP); Jun Urasaki, Tokyo (JP)

(73) Assignee: MITSUBISHI PAPER MILLS LIMITED, Tokyo (JP)

( * ) Notice: Subject to any disclaimer, the term of this patent is extended or adjusted under 35 U.S.C. 154(b) by 0 days.

(21) Appl. No.: 16/615,230

(22) PCT Filed: Apr. 9, 2018

(86) PCT No.: PCT/JP2018/014974
§ 371 (c)(1),
(2) Date: Nov. 20, 2019

(87) PCT Pub. No.: WO2018/225370
PCT Pub. Date: Dec. 13, 2018

(65) Prior Publication Data

US 2020/0181837 A1 Jun. 11, 2020

(30) Foreign Application Priority Data

Jun. 7, 2017 (JP) ..... JP2017-112664
Jun. 7, 2017 (JP) ..... JP2017-112665
Jun. 7, 2017 (JP) ..... JP2017-112666

(51) Int. Cl.
*B41M 5/50* (2006.01)
*B41M 5/52* (2006.01)

(52) U.S. Cl.
CPC ..... *B41M 5/5218* (2013.01); *B41M 5/52* (2013.01); *B41M 5/5254* (2013.01)

(58) Field of Classification Search
CPC ..... B41M 5/50; B41M 5/508; B41M 5/52; B41M 5/5218; B41M 5/5254
USPC ..... 428/32.21
See application file for complete search history.

(56) References Cited

U.S. PATENT DOCUMENTS

| | | | | |
|---|---|---|---|---|
| 6,139,672 | A | 10/2000 | Sato et al. | |
| 6,242,082 | B1 | 6/2001 | Mukoyoshi et al. | |
| 2005/0233098 | A1* | 10/2005 | Asano | B41M 5/5254 428/32.34 |
| 2009/0066774 | A1* | 3/2009 | Kubota | B41M 5/502 347/106 |
| 2020/0181837 | A1* | 6/2020 | Igarashi | B41M 5/52 |

FOREIGN PATENT DOCUMENTS

| | | | | |
|---|---|---|---|---|
| JP | 61-692 | A | 1/1986 | |
| JP | 11-42898 | A | 2/1999 | |
| JP | 11-91240 | A | 4/1999 | |
| JP | 2002-292995 | A | 10/2002 | |
| JP | 2002292995 | * | 10/2002 | B41M 5/00 |
| JP | 2006-256156 | A | 9/2006 | |
| JP | 21107-118532 | A | 5/2007 | |
| JP | 2009-18550 | A | 1/2009 | |
| JP | 2010-158875 | A | 7/2010 | |
| JP | 2015-124324 | A | 7/2015 | |
| JP | 2015-168705 | A | 9/2015 | |
| JP | 6310138 | B1 | 4/2018 | |

* cited by examiner

*Primary Examiner* — Betelhem Shewareged
(74) *Attorney, Agent, or Firm* — Birch, Stewart, Kolasch & Birch, LLP.

(57) ABSTRACT

The object is to provide a transfer paper having good image deterioration resistance, color development property and adhesion property.

The object is achieved by a transfer paper for use in a transfer textile printing method using sublimation textile ink, which comprises a base paper and one or more coating layer(s) provided on at least one side of the base paper, wherein an outermost coating layer positioned on the outermost side with respect to the base paper contains at least a pigment and a binder, at least one of the pigment is amorphous silica, and the binder contains two or more different binders, and at least one of the binders is an ethylene-vinyl acetate copolymer.

12 Claims, No Drawings

TRANSFER PAPER

TECHNICAL FIELD

The present invention relates to a transfer paper used for transferring an pattern in a transfer textile printing method for forming a pattern on a printing substrate such as a fiber material.

BACKGROUND ART

As a method for forming a pattern on a printing substrate such as a fiber material, a transfer textile printing method is known in which a pattern is printed on a transfer paper using sublimation textile ink to prepare a printed transfer paper, and the printed transfer paper is brought into close contact with the printing substrate to transfer the sublimation textile ink onto the printing substrate (see, for example, Patent Document 1 and Patent Document 2).

A transfer paper used for a transfer textile printing method is known.

For a sublimation transfer paper which is used in the sublimation transfer printing system, can obtain a clear recorded image excellent in absorptivity of aqueous ink and free from bleeding, and is also excellent in ink transfer efficiency to a transfer object during sublimation transfer, a transfer paper comprising a sheet type base material, and an ink receiving layer provided on one side or both sides of the sheet type base material, wherein the ink receiving layer contains a pigment, a binder, and a cationic resin, and as the pigment, precipitated silica is used, and as the binder, any one of starch, starch derivative, polyvinyl alcohol and modified polyvinyl alcohol, or a mixture of two or more thereof is used, is known (see, for example, Patent Document 3).

As a method of printing a pattern on a transfer paper using an ink containing a sublimation dye or a sublimation textile ink to prepare a printed transfer paper, an inkjet printing method is often used as described in Patent Document 3.

PRIOR ART DOCUMENTS

Patent Documents

Patent Document 1: Japanese Patent Application Kokai Publication No. 2015-168705 (unexamined, published Japanese patent application)

Patent Document 2: Japanese Patent Application Kokai Publication No. 2015-124324 (unexamined, published Japanese patent application)

Patent Document 3: Japanese Patent Application Kokai Publication No. 2010-158875 (unexamined, published Japanese patent application)

SUMMARY OF THE INVENTION

Problems to be Solved by the Invention

It is necessary to have two contradictory characteristics between a transfer paper which is a blank paper before a pattern is printed and a printed transfer paper which is obtained by printing a pattern on the transfer paper. That is, the transfer paper is required to have an ability to successfully receive a sublimation textile ink, while the printed transfer paper is required to have an ability to successfully transfer the sublimation textile ink to a printing substrate.

It is necessary for a transfer paper to improve its receptivity to a sublimation textile ink in order to become a printed transfer paper having a sharp image so as not to deteriorate the image quality of a pattern formed on a printing substrate. Furthermore, it is necessary for a transfer paper not to deteriorate the image quality of a pattern formed on a printing substrate from the printed transfer paper having a sharp image.

On the other hand, if the receptivity of the transfer paper to the sublimation textile ink is improved, there is a case in the printed transfer paper that transfer of the sublimation textile ink becomes insufficient at the time of transferring for forming a pattern on the printing substrate. As a result, reduction in color development occurs in the printing substrate.

In order to carry out transfer by bringing a printed transfer paper and a printing substrate into close contact with each other, the printed transfer paper must be able to adhere well to the printing substrate. Apart from the deterioration of image quality at the time of image formation as described above, there is a problem of image quality which occurs due to poor adhesion between the transfer paper and the printing substrate. Out-of-focus or distortion or the like of an image occurs in a region where the transfer paper and the printing substrate are not in close contact with each other.

In the case of continuously transferring to a printing substrate, a printed transfer paper in the form of roll paper is brought into close contact with the printing substrate to carry out transfer. In particular, in order to continuously carry out transfer, it is more important that the printed transfer paper adheres well to the printing substrate.

Apart from the color development of patterns formed on a printing substrate, there is also a problem of textile printing unevenness of the printing substrate with respect to color. The textile printing unevenness is a phenomenon in which color development partially decreases in a final printing substrate with respect to a region which should have a uniform color in transfer paper. The former phenomenon in which the color development of the pattern decreases is a phenomenon in which the transfer of the sublimation textile ink is insufficient on the whole of the image from the transfer paper. On the other hand, the latter textile printing unevenness is a phenomenon in which the sublimation textile ink is insufficiently transferred on the partial of the image from the transfer paper. The textile printing unevenness tends to occur, in particular, when transferring to a printing substrate continuously using a printed transfer paper in the form of roll.

In addition, there is a problem of transferability when sublimation textile ink is transferred from a transfer paper to a printing substrate. Transfer is carried out by bringing the transfer paper and the printing substrate into close contact, and heating and pressurizing as necessary. In the case of forming an image on a printing substrate as an industry, it is desirable that the transfer of the sublimation textile ink saturates for a shorter time, lower heating and lower pressure. The efficiency relating to such transfer is referred to as transferability in the present invention. In particular, time is important as an industry.

The quality of the sublimation transfer sheet of Patent Document 3 is not necessarily sufficient and improvement is desired with respect to adhesion property, textile printing unevenness and transferability.

The ink transfer efficiency described in Patent Document 3 is a value determined from the amount of sublimation textile ink remaining on a transfer paper. The lower the amount of sublimation textile ink remaining on the transfer paper after the transfer finishes, the higher the ink transfer efficiency to the printing substrate is. By transferring more sublimation textile inks to the printing substrate, the color development of the image transferred to the printing substrate is improved. That is, the ink transfer efficiency of Patent Document 3 is a problem close to the color development property of the present invention, which is different from the transferability of the present invention.

In view of the above, an object of the present invention is to provide a transfer paper satisfying the following items.

(1) Deterioration of an image in a printing substrate can be suppressed (image deterioration resistance).

(2) Reduction of color development in a printing substrate can be suppressed (color development property)

(3) A printed transfer paper and a printing substrate are well adhered (adhesion property)

An object of the present invention is to provide a transfer paper satisfying the following (4) and/or (5) according to a further preferred embodiment.

(4) Textile printing unevenness can be suppressed in a printing substrate (resistance to textile printing unevenness)

(5) Efficiency relating to transfer from a printed transfer paper to a printing substrate is excellent (transferability)

Means for Solving the Problems

As a result of extensive studies to solve the above problems, the present inventors have accomplished the object of the present invention by the following.

[1] A transfer paper for use in a transfer textile printing method using sublimation textile ink, which comprises a base paper and one or more coating layer(s) provided on at least one side of the base paper, wherein an outermost coating layer positioned on the outermost side with respect to the base paper contains at least a pigment and a binder, at least one of the pigment is amorphous silica, and the binder contains two or more different binders, and at least one of the binders is an ethylene-vinyl acetate copolymer.

According to the above [1], a transfer paper having excellent image deterioration resistance, color development property and adhesion property can be obtained.

[2] The transfer paper according to [1], wherein a glass transition temperature of the ethylene-vinyl acetate copolymer is more than 0° C.

According to the above [2], the color development property or the adhesion property of the transfer paper is further improved.

[3] The transfer paper according to [1] or [2], wherein the ethylene-vinyl acetate copolymer has an average particle diameter of 0.08 μm or more and 0.3 μm or less.

According to the above [3], the color development property or the adhesion property of the transfer paper is further improved.

[4] The transfer paper according to any one of the above [1] to [3], wherein the binder contains two or more different binders, and at least two of the binders are an ethylene-vinyl acetate copolymer and a silanol-modified polyvinyl alcohol.

According to the above [4], it is possible to obtain more excellent resistance to textile printing unevenness of the transfer paper.

[5] The transfer paper according to any one of the above [1] to [4], wherein the base paper contains a filler, and at least one of the filler is calcined kaolin.

According to the above [5], it is possible to obtain more excellent transferability of the transfer paper.

[6] The transfer paper according to [5], wherein the base paper is an acidic paper.

According to the above [6], the transfer paper has better transferability.

Effect of the Invention

According to the present invention, it is possible to provide a transfer paper having good image deterioration resistance, color development property and adhesion property. According to a further preferred embodiment, it is possible to provide a transfer paper having good resistance to textile printing unevenness and/or transferability.

Mode for Carrying Out the Invention

The present invention will be described below in detail.

In the present invention, the term "transfer paper" means a paper in a blank state before a pattern to be transferred is printed. The term "printed transfer paper" means a paper on which a pattern to be transferred has been printed with respect to the transfer paper.

In the present invention, "having a coating layer" means a paper having a distinct layer distinguishable from a base paper when observing a cross section of a transfer paper with an electron microscope. For example, when a resin component or a polymer component has been applied and the said applied component has been absorbed by a base paper, and then the cross section of the transfer paper is observed with an electron microscope to have confirmed that it does not have a distinct clear coating layer distinguishable from the base paper, such a paper does not fall under "having a coating layer".

The transfer paper has a base paper and one or more coating layer(s) on at least one side of the base paper. In the coating layer, a coating layer positioned on the outermost side with respect to the base paper is referred to as an outermost coating layer. When the coating layer is one layer, the coating layer corresponds to the outermost coating layer.

The outermost coating layer contains at least a pigment and a binder, and at least one of the pigment is amorphous silica, and the binder contains two or more different binders and at least one of the binders is an ethylene-vinyl acetate copolymer. In the case of two or more coating layers, the coating layer existing between the base paper and the outermost coating layer may be either a coating layer containing a pigment and a binder or a coating layer without containing a pigment. Also, there is no particular limitation on the type of pigment or binder.

From the viewpoint of production cost, the coating layer is preferably one layer. The coating layer may be provided on one side or both sides of the base paper. When the outermost coating layer according to the present invention is provided on one side of the base paper, the transfer paper may have a conventionally known back coat layer on the back face of the base paper.

The coating amount of the coating layer is not particularly limited. From the viewpoint of the production cost of a transfer paper and ease of handling, the coating amount is preferably 2 g/m$^2$ or more and 70 g/m$^2$ or less in terms of dry solid content per one side. The upper limit of the coating amount is more preferably 30 g/m$^2$ or less, still more preferably 20 g/m$^2$ or less. Furthermore, the coating amount is most preferably 5 g/m$^2$ or more and 15 g/m$^2$ or less per side, because the production cost can be reduced and it is possible to prevent a part of the coating layer of the transfer paper from being missing when adhering to a printing substrate. When there are a plurality of coating layers per one side, the coating amount is the total value thereof.

The base paper is a papermaking paper obtained by making a paper stock containing at least one pulp selected from chemical pulp such as LBKP (Leaf Bleached Kraft Pulp) and NBKP (Needle Bleached Kraft Pulp), mechanical pulp such as GP (Groundwood Pulp), PGW (Pressure Ground Wood pulp), RMP (Refiner Mechanical Pulp), TMP (Thermo Mechanical Pulp), CTMP (ChemiThermoMechanical Pulp), CMP (Chemi Mechanical Pulp) and CGP (Chemi Groundwood Pulp), and waste paper pulp such as DIP (DeInked Pulp), various fillers such as ground calcium carbonate, precipitated calcium carbonate, talc, clay, kaolin and calcined kaolin, and various additives such as a sizing agent, a fixing agent, a retention aid, a cationizing agent and a paper strengthening agent as required into a paper. Further, the base paper includes woodfree paper which is subjected to calendering processing, surface sizing with starch, polyvinyl alcohol or the like, or surface treatment or the like on a papermaking paper. Further, the base paper includes woodfree paper which has been subjected to calendering processing after subjected to surface sizing or surface treatment.

The base paper preferably contains a filler. It is preferable that at least one of the filler is calcined kaolin. When at least one of the filler is calcined kaolin, the transfer paper can obtain transferability in addition to image deterioration resistance, color development property and adhesion property. The content of calcined kaolin in the base paper is preferably 10 parts by mass or more and 20 parts by mass or less based on 100 parts by mass of the pulp in the base paper. When the content of calcined kaolin falls within the above range, image deterioration resistance, color development property or transferability becomes better. In addition, it is preferable that the calcined kaolin occupies 60% by mass or more of the filler in the base paper.

Calcined kaolin can be obtained by various production methods. The calcined kaolin of the present invention does not limit the production method. Calcined kaolin can be broadly classified into partially calcined kaolin obtained by calcining kaolinite at a temperature of about 650° C. to 700° C. and fully calcined kaolin obtained by calcining kaolinite at 1000° C. to 1050° C. The calcined kaolin may be either partially calcined kaolin or fully calcined kaolin.

The base paper preferably has an ash content of 5% by mass or more and 35% by mass or less. The ash content can be adjusted by the amount of the filler contained in the base paper. Ash content is a value determined according to ISO 1762:2001 "Paper, board and pulps—Determination of residue (ash) on ignition at 525 degrees C." (JIS P8251:2003 "Paper, board and pulps—Determination of residue (ash) on ignition at 525 degrees C.").

Paper making is carried out by adjusting a paper stock to acidic, neutral or alkaline and using a conventionally known papermaking machine. Examples of a papermaking machine include a fourdrinier papermaking machine, a twin wire papermaking machine, a combination papermaking machine, a cylindrical papermaking machine, a yankee papermaking machine and the like.

The base paper is preferably an acidic paper.

Acid paper refers to a base paper having pH of cold aqueous extracts of less than 6 measured according to the method based on ISO 6588-1:2012 "Paper, board and pulps—Determination of pH of aqueous extracts—Part 1: Cold extraction" (common to JIS P 8133-1:2013 "Paper, board and pulps—Determination of pH of aqueous extracts—Part 1: Cold extraction"). The lower limit of the pH is preferably 4.5 or more from the viewpoint of paper deterioration. The reason for this is that the synergistic effect of the base paper as acidic paper, the calcined kaolin in the base paper and the outermost coating layer makes the transferability even better.

The basis weight of the base paper is not particularly limited. From the viewpoint of ease of handling of paper, the basis weight of the base paper is preferably 10 g/m$^2$ or more and 100 g/m$^2$ or less, more preferably 30 g/m$^2$ or more and 100 g/m$^2$ or less. Further, the thickness of the transfer paper is not particularly limited. The thickness of the transfer paper is preferably 0.01 mm or more and 0.5 mm or less, and more preferably 0.05 mm or more and 0.3 mm or less from the viewpoint of ease of handling for transfer to a printing substrate.

In the paper stock, one or two or more of other additives selected from a binder, a pigment dispersant, a thickener, a fluidity improving agent, a defoamer, an antifoamer, a releasing agent, a foaming agent, a penetrating agent, a colored dye, a colored pigment, an optical brightener, an ultraviolet light absorber, an antioxidant, a preservative, a fungicide, an insolubilizer, an wet paper strengthening agent, a dry paper strengthening agent and the like can be blended appropriately as long as the desired effect of the present invention is not impaired.

The coating layer can be provided on the base paper or the coating layer by applying and drying each coating layer-coating composition on the base paper or the coating layer.

The method of providing a coating layer is not particularly limited. For example, an applying method and a drying method using a coating apparatus and a drying apparatus conventionally known in the field of papermaking can be mentioned. Examples of the conventionally known coating apparatus may include a size press, a gate roll coater, a film transfer coater, a blade coater, a rod coater, an air knife coater, a comma coater, a gravure coater, a bar coater, an E bar coater, a curtain coater, and the like. Examples of the drying apparatus may include a hot air dryer such as a straight tunnel dryer, an arch dryer, an air loop dryer and a sine curve air float dryer, an infrared heating dryer, a dryer using microwave, and the like.

In addition, the coating layer can be subjected to calendering processing after applying and drying.

The outermost coating layer contains at least a pigment and a binder.

The outermost coating layer contains at least amorphous silica as a pigment and two or more different binders as a binder, and at least one of the binders is an ethylene-vinyl acetate copolymer.

The total content ratio of the pigment and the binder in the outermost coating layer is preferably 60% by mass or more in terms of the dry solid content of the outermost coating layer. The content ratio of the binder in the outermost coat layer is preferably 20 parts by mass or more and 50 parts by mass or less based on 100 parts by mass of the pigment in the outermost coating layer.

The content ratio of the amorphous silica in the outermost coating layer is preferably 80 parts by mass or more based on 100 parts by mass of the pigment in the outermost coating layer.

The content ratio of the ethylene-vinyl acetate copolymer in the outermost coating layer is preferably 5 parts by mass or more and 35 parts by mass or less based on 100 parts by mass of the binder in the outermost coating layer.

Amorphous silica can be roughly classified into wet process silica and fumed silica according to a production method. Further, the wet process silica can be classified into precipitated silica and gel process silica according to a production method. Precipitated silica is produced by reacting sodium silicate and sulfuric acid under an alkaline condition, in which silica particles which have grown the particles are aggregated and precipitated, and then through steps of filtration, water washing, drying, pulverization and classification, to produce the precipitated silica. The precipitated silica is commercially available as, for example, Nipsil from TOSOH SILICA CORPORATION, and Finesil and Tokusil from Oriental Silicas Corporation. Gel process silica is produced by reacting sodium silicate and sulfuric acid under an acidic condition. During aging, the microparticles are dissolved and reprecipitated so as to bind the other primary particles to each other, so that clear primary particles disappear and relatively hard agglomerated particles having an internal void structure are formed. Gel process silica is commercially available as, for example, NIPGEL from TOSOH SILICA CORPORATION, and SYLOID and SYLOJET from W. R. Grace & CO. Fumed silica is also called a dry process silica in contrast to a wet process silica, and is generally produced by a flame hydrolysis method. Specifically, it is generally known that silicon tetrachloride is burned together with hydrogen and oxygen to produce it. Instead of silicon tetrachloride, silanes such as methyltrichlorosilane and trichlorosilane can be used alone or in combination with silicon tetrachloride. Fumed silica is commercially available as AEROSIL from NIPPON AEROSIL CO., LTD., and REOLOSIL from Tokuyarna Corporation.

Amorphous silica is preferably precipitated silica.

In addition to the amorphous silica, the outermost coating layer may contain a conventionally known pigment.

Examples of the conventionally known pigment may include inorganic pigments such as ground calcium carbonate, precipitated calcium carbonate, talc, kaolin, satin white, lithopone, titanium oxide, zinc oxide, colloidal silica, alumina, aluminum hydroxide, zinc oxide, activated clay and diatomaceous earth, and organic pigments such as plastic pigments. The outermost coating layer can contain, in combination with amorphous silica, one or combination of two or more selected from the group consisting of these pigment.

The ethylene-vinyl acetate copolymer is a copolymer obtained by copolymerization of an ethylene monomer and a vinyl acetate monomer. The ethylene-vinyl acetate copolymer can be obtained by a production method, which comprises, for example, copolymerizing an ethylene monomer and a vinyl acetate monomer by an emulsion polymerization method using polyvinyl alcohol or the like as a protective colloid, and a cellulose type derivative such as hydroxyethyl cellulose, a surfactant or the like as an emulsifying dispersant in combination. In addition, ethylene-vinyl acetate copolymers are already commercially available from companies, such as SUMIKAFLEX of Sumitomo Chemical Co. Ltd., CHEMIPEARL of Mitsui Chemicals, Inc., and PANFLEX of Kuraray Co., Ltd.

In the present invention, when the content of the conventionally known monomers in the copolymer used in the emulsion polymerization other than the ethylene monomer and the vinyl acetate monomer is less than 30% by mass and the effect of the present invention is not inhibited, such a copolymer is included in the ethylene-vinyl acetate copolymer of the present invention. Further, a part of the vinyl acetate monomer can be substituted with vinyl propionate, vinyl butanoate or vinyl hexanoate.

The glass transition temperature of the ethylene-vinyl acetate copolymer is preferably more than 0° C. The upper limit of the glass transition temperature is not particularly limited, but is preferably 35° C. or lower, more preferably at or below the glass transition temperature of the polymerization monomer composed of vinyl acetate.

The glass transition temperature of the ethylene-vinyl acetate copolymer can be adjusted by the content fraction of the monomers constituting the copolymer. Generally, as the ethylene monomer content increases, the glass transition temperature of the copolymer decreases, and as the vinyl acetate monomer content increases, the glass transition temperature of the copolymer increases.

The glass transition temperature is a value calculated from the mass ratio of the monomer of each polymer portion according to the following Fox formula.

$$1/Tg=(W_1/Tg_1)+(W_2/Tg_2)+\ldots+(W_m/Tg_m)$$

$$W_1+W_2+\ldots+W_m=1$$

In the formula, Tg represents the glass transition temperature of the polymer, and $Tg_1$, $Tg_2$, . . . , $Tg_m$ represent the glass transition temperatures of homopolymers composed of the respective polymerizable monomers. The unit of temperature is K. $W_1$, $W_2$, . . . , $W_m$ represent mass ratios of the respective polymerizable monomers.

For the glass transition temperature of each polymerizable monomer in the Fox formula, for example, the values described in Polymer Handbook Third Edition (Wiley-Interscience 1989) may be used.

The average particle diameter of the ethylene-vinyl acetate copolymer is preferably 0.08 μm or more and 0.3 μm or less. The average particle diameter of the ethylene-vinyl acetate copolymer is a value obtained by magnifying and observing the ethylene-vinyl acetate copolymer to be used for the outermost coating layer with an electron microscope, and measuring the diameter of any observed 100 particles using analysis software or the like.

The adjustment of the particle diameter during the emulsion polymerization is already known, as described in, for example, JP 2007-193343 A. The average particle diameter of the ethylene-vinyl acetate copolymer can be generally controlled by an emulsifier concentration and a polymerization initiator concentration in the emulsion polymerization.

When the glass transition temperature of the ethylene-vinyl acetate copolymer exceeds 0° C. or when the average particle diameter of the ethylene-vinyl acetate copolymer is 0.08 μm or more and 0.3 μm or less, color development property or adhesion property becomes better. The reason for these is unknown. The inventors think about the reason as follows. The ethylene-vinyl acetate copolymer having such a glass transition temperature exhibits flexibility because it has a relatively large number of acetoxy groups while having an appropriate spacing in the copolymer, and therefore acts on adhesion. The ethylene-vinyl acetate copolymer having a relatively small average particle diameter is easily dispersed in the outermost coating layer and easily forms a film in the vicinity of the amorphous silica, and moderately suppress the interaction between the amorphous silica and the ink, and therefore affects the color development property.

The outermost coating layer may contain a conventionally known binder other than the ethylene-vinyl acetate copolymer.

Examples of the conventionally known binder may include starch and various modified starches; cellulose derivatives such as carboxymethyl cellulose and hydroxyethyl cellulose; natural polymer resin such as casein, gelatin, soybean protein, pullulan, gum arabic, karaya gum and albumin or a derivative thereof; polyvinyl pyrrolidone; polyvinyl alcohol and various modified polyvinyl alcohols; polypropylene glycol; polyethylene glycol; maleic anhydride resin; acrylic type resin; methacrylate-butadiene copolymer except for ethylene-vinyl acetate copolymer, a styrene-butadiene copolymer, or a functional group-modified copolymers of these various copolymers with monomers containing a functional group such as carboxy group; a binder such as a thermosetting synthetic resin such as a melamine resin and an urea resin; polyurethane resins; unsaturated polyester resins; polyvinyl butyral; alkyd resins, and the like. The outermost coating layer can contain one or a combination of two or more of these binders in combination with the ethylene-vinyl acetate copolymer.

From the viewpoint of adhesion property, the binder to be used in combination with the ethylene-vinyl acetate copolymer is preferably at least one selected from the group consisting of starch and various modified starch thereof, and polyvinyl alcohol and various modified polyvinyl alcohols thereof.

Preferably, the outermost coating layer contains two or more different binders, and at least two of the binders are an ethylene-vinyl acetate copolymer and a silanol-modified polyvinyl alcohol. The reason for this is that the transfer paper can obtain the resistance to textile printing unevenness.

The combined content ratio of the ethylene-vinyl acetate copolymer and the silanol-modified polyvinyl alcohol in the outermost coating layer is preferably 90 parts by mass or more based on 100 parts by mass of the binder in the outermost coating layer. In addition, the content ratio of the ethylene-vinyl acetate copolymer to the silanol-modified polyvinyl alcohol in the outermost coating layer is preferably ethylene-vinyl acetate copolymer:silanol-modified polyvinyl alcohol=5:95 to 35:65.

The silanol-modified polyvinyl alcohol is a polyvinyl alcohol having a silanol group. The silanol-modified polyvinyl alcohol can be obtained, for example, by saponifying a copolymer of vinylalkoxysilane and vinyl acetate. Silanol-modified polyvinyl alcohol is already commercially available, and an example thereof is R polymer of Kuraray Co., Ltd.

By combining an ethylene-vinyl acetate copolymer and a silanol-modified polyvinyl alcohol as the binder of the outermost coating layer, the transfer paper can obtain resistance to textile printing unevenness in addition to image deterioration resistance, color development property and adhesion property. The reason for this is unknown. The present inventors believe the reason for this as follows. The coating obtained with the silanol-modified polyvinyl alcohol has very high crystallinity and the coating is physically stable. For this reason, the stability at the time of contact between the transfer paper and the printing substrate can be obtained. As a result, textile printing unevenness is suppressed.

Besides the ethylene-vinyl acetate copolymer and the silanol-modified polyvinyl alcohol, the outermost coating layer can contain a conventionally known binder.

The outermost coating layer may contain various additives conventionally known in the field of coated paper, if necessary, in addition to the pigment and the binder. Examples of the additives may include a dispersant, a fixing agent, a cationizing agent, a thickener, a fluidity improving agent, a defoamer, a releasing agent, a foaming agent, a penetrating agent, a colored pigment, a colored dye, an optical brightener, an ultraviolet light absorbing agent, an antioxidant, a preservative, fungicide and the like.

Further, the outermost coating layer can contain various auxiliaries conventionally known in a transfer textile printing method. The auxiliaries are added to optimize various physical properties of the outermost coating layer-coating composition or to improve the dyeability of the sublimation textile ink to be transferred. Examples of the auxiliaries may include various surfactants, a humectant, a wetting agent, a pH adjusting agent, an alkaline agent, a color-deepening agent, a deaerator, a reducing inhibitor and the like.

The outermost coating layer preferably contains a cationic resin.

The cationic resin may be any conventionally known cationic polymer or cationic oligomer, and is not particularly limited. A preferred cationic resin is a polymer or oligomer containing a primary to tertiary amine or a quaternary ammonium salt which proton easily coordinates and dissociates when dissolved in water to exhibit cationic properties. Examples of the cationic resin include compounds such as polyethyleneimine, polyvinylpyridine, polyamine sulfone, polydialkylaminoethyl methacrylate, polydialkylaminoethyl acrylate, polydialkylaminoethyl methacrylamide, polydialkylaminoethylacrylamide, polyepoxyamine, polyamidoamine, dicyandiamide-formalin polycondensate, dicyandiamide polyalkyl-polyalkylene polyamine polycondensate, polyvinylamine, polyallylamine and the like and hydrochlorides thereof, diallylamine-acrylamide copolymer, copolymer of polydiallyldimethylammonium chloride or diallyldimethylammonium chloride and acrylamide and the like, polydiallylmethylamine hydrochloride, polycondensation products of an alkylamine and an epihalohydrin compound such as a dimethyl amine-ammonia-epichlorohydrin polycondensate and a dimethylamine-epichlorohydrin polycondensate. The cationic resin is one or more selected from the group consisting of these.

The cationic resin is preferably one or more selected from the group consisting of a polycondensate of an alkylamine and an epihalohydrin compound, a diallylamine-acrylamide copolymer, and polydiallyldimethylammonium chloride.

The content of the cationic resin in the outermost coating layer is preferably 15 parts by mass or more and 35 parts by mass or less based on 100 parts by mass of the pigment in the outermost coating layer.

The reason for containing the cationic resin is that the image deterioration resistance is more improved.

A printed transfer paper can be obtained by printing a pattern on the side having the outermost coating layer of a transfer paper using various conventionally known printing methods using sublimation textile ink.

Various printing methods for printing a pattern on a transfer paper are conventionally known printing methods, and are not particularly limited. Examples of the printing method may include a gravure printing method, an inkjet printing method, an electrophotographic printing method, a screen printing method, and the like. Among them, an inkjet printing method is preferable from the viewpoints of high definition of image quality and downsizing of the apparatus.

The transfer textile printing method using sublimation textile ink is a method having a step of printing a pattern on a transfer paper to obtain a printed transfer paper and a step of bringing the printed transfer paper into close contact with a printing substrate. The step of bringing into close contact includes heating and pressurizing as necessary. Conditions of heating and pressurizing in the step of bringing into close contact are conventionally known conditions in a sublimation transfer printing method. As the step of bringing into close contact, for example, there can be mentioned a method of bringing a printed transfer paper into close contact with a printing substrate by a pressing machine, a heating drum or the like, and heating and pressurizing.

The printing substrate is a fiber material, and is not particularly limited. The fiber material may be either a natural fiber material or a synthetic fiber material. Examples of the natural fiber material may include cellulosic fiber materials such as cotton, linen, lyocell, rayon and acetate, and protein type fiber materials such as silk, wool and animal hair. Examples of the synthetic fiber material may include polyamide fiber (nylon), vinylon, polyester, polyacrylic and the like. As a configuration of the fiber material, there can be mentioned single, blended, mixed fiber or interwoven fabric such as woven fabric, knitted fabric and nonwoven fabric. Furthermore, these configurations may be combined. If necessary, the printing substrate may be pretreated with a chemical or the like effective for promoting dyeing.

In the transfer textile printing method using a sublimation textile ink, the printing substrate is preferably a synthetic fiber material. Pretreatment is often required for natural fiber materials.

EXAMPLES

Hereinafter, the present invention will be described in more detail by examples. It should be noted that the present invention is not limited to these examples. Here, "part by mass" and "% by mass" each represent "parts by mass" and "% by mass" of a dry solid content or a substantial component amount. A coating amount of a coating layer represents a dry solid content.

Examples 1 to 23 and Comparative Examples 1 to 6

<Base Paper>

(Base Paper 1)

12 parts by mass of calcined kaolin (BASF, Ansirex), 4 parts by mass of oxidized starch (NIHON SHOKUHIN KAKO CO., LTD., MS #3800), 0.3 part by mass of rosin sizing agent, 0.6 part by mass of polyacrylamide resin, 0.5 part by mass of aluminum sulfate were added to a pulp slurry containing 100 parts by mass of pulp consisting of 90 parts by mass of LBKP having a freeness degree of 450 ml csf and 10 parts by mass of NBKP having a freeness degree of 440 ml csf to form a paper stock, and the pH of the paper stock was adjusted so that the pH of the base paper to be obtained was 4.5 or more and less than 6. After preparing the paper stock, paper was made using a fourdrinier papermaking machine so as to have a basis weight of 100 g/m$^2$, to obtain a base paper 1.

<Outermost Coating Layer-Coating Composition and Coating Layer-Coating Composition>

The following materials were blended with water as a medium and the concentration of a coating solution was adjusted to 13% by mass to prepare an outermost coating layer-coating composition and a coating layer-coating composition for providing between the outermost coating layer and the base paper. The number of blending parts is described in Table 1. The ethylene-vinyl acetate copolymer was prepared by emulsion polymerization. The glass transition temperature and the average particle diameter were determined by the method described above. The following "Tg" refers to the glass transition temperature. The symbols in Table 1 indicate the following materials.

P1: Amorphous silica (Oriental Silicas Corporation, Finesil X-37B)

P2: Precipitated calcium carbonate (SHIRAISHI CALCIUM KAISHA, LTD., Brilliant-15)

P3: Kaolin (SHIRAISHI CALCIUM KAISHA, LTD., Kaofine 90)

E1: Ethylene-vinyl acetate copolymer (Tg 15° C., average particle diameter 0.1 μm)

E2: Ethylene-vinyl acetate copolymer (Tg −2° C., average particle diameter 0.2 μm)

E3: Ethylene-vinyl acetate copolymer (Tg −6° C., average particle diameter 0.3 μm)

E4: Ethylene-vinyl acetate copolymer (Tg 0° C., average particle diameter 0.5 μm)

E5: Ethylene-vinyl acetate copolymer (Tg 5° C., average particle diameter 0.3 μm)

E6: Ethylene-vinyl acetate copolymer (Tg 10° C., average particle diameter 0.7 μm)

E7: Ethylene-vinyl acetate copolymer (Tg 5° C., average particle diameter 0.09 μm)

E8: Ethylene-vinyl acetate copolymer (Tg −4° C., average particle diameter 0.1 μm)

B1: Polyvinyl alcohol (Kuraray Co., Ltd., PVA 117)

B2: Silanol-modified polyvinyl alcohol (Kuraray Co., Ltd., R-1130)

B3: Styrene-butadiene copolymer (JSR Corporation, JSR-2605G)

B4: Starch (NIHON SHOKUHIN KAKO CO., LTD., MS #3000)

A1: Cationic resin (Taoka Chemical Co., Ltd., Sumirez Resin 1001)

<Transfer Paper of Examples 1 to 20 and Comparative Examples 1 to 5>

The outermost coating layer-coating composition was applied on one side of the base paper 1 with an air knife coater so as to make the coating amount 9 g/m$^2$, and dried in a hot air dryer. After that, it was subjected to super calendering processing to obtain a transfer paper.

<Transfer Paper of Examples 21-23 and Comparative Example 6>

The coating layer-coating composition was applied on one side of the base paper 1 with a blade coater so as to make the coating amount 5 g/m$^2$, and dried in a hot air dryer. Subsequently, the outermost coating layer-coating composition was applied on the coating layer with an air knife coater so as to make the coating amount 9 g/m$^2$, and dried in a hot air dryer. After that, it was subjected to super calendering processing to obtain a transfer paper.

<Preparation of Printed Transfer Paper>

Evaluation patterns with sublimation textile inks (cyan, magenta, yellow, black) were printed on each obtained transfer paper using an inkjet printer (N2-130 II, manufactured by Mimaki Engineering Co., Ltd.) using the sublimation textile inks to obtain each printed transfer paper (roll paper).

<Textile Printing (Roll Paper)>

Rolled polyester cloth was used as a printing substrate. The resultant roll paper-state printed transfer paper and the polyester cloth were brought into close contact with each other, and the dye was transferred to the polyester cloth using a heating and pressing machine (200° C., 0.5 MPa, 2.0 m/min, roller type, contact time with rollers for 45 seconds). Thereafter, the printed transfer paper was peeled off from the polyester cloth to obtain a polyester cloth having a pattern formed thereon.

<Evaluation of Image Deterioration Resistance>

From the viewpoint of the sharpness of the pattern, the image deterioration resistance of the polyester cloth having the pattern formed thereon was visually evaluated according to the following criteria. In the present invention, if the evaluation is 3 or 4, the transfer paper is judged to have image deterioration resistance.

4: Good level.

3: Deterioration of image quality is hardly recognized and it is generally good level.

2: Deterioration of image quality is recognized, but it is practically problem free level.

1: Level at which deterioration of image which becomes practically unusable is recognized.

<Evaluation of Color Development Property>

In the textile printed printing substrate, the color density of the solid image portion of three sublimation textile inks (cyan, magenta, yellow) was measured with an optical densitometer (X-rite 530, manufactured by SAKATA INX ENG. CO., LTD.), and color density values of three colors were added up. Color development property was judged according to the following criteria. In the present invention, if the evaluation is 3 or 4, the transfer paper is judged to have good color development property.

4: Total value is 4.8 or more

3: Total value is 4.5 or more and less than 4.8

3: Total value is 4.2 or more and less than 4.5

1: Total value is less than 4.2

<Evaluation of Adhesion Property>

From the viewpoint of the degree of occurrence of out-of-focus and distortion of the pattern, the printing substrate having the pattern formed thereon was visually evaluated on adhesion property according to the following criteria. In the present invention, if the evaluation is 3 or 4, the transfer paper is judged to have excellent adhesion property.

A: Out-of-focus and distortion are not observed, and it is good level.

B: Out-of-focus and distortion are scarcely observed, and it is generally good level.

C: Out-of-focus and distortion are observed, but it is practically problem free level.

D: Out-of-focus and distortion are observed, and it is a problematic level in practical use.

The evaluation results are shown in Table 1.

TABLE 1

| | Outermost coating layer | | | | | | Coating layer | | | | | | |
|---|---|---|---|---|---|---|---|---|---|---|---|---|---|
| | Pigment | | Binder | | Additives | | Pigment | | Binder | | Image | Color | |
| | Type | Parts by mass | Type | Parts by mass | Type | Parts by mass | Type | Parts by mass | Type | Parts by mass | deterioration resistance | development property | Adhesion property |
| Example 1 | P1 | 100 | E1 | 2 | — | — | — | — | — | — | 3 | 4 | 4 |
| | | | B1 | 33 | | | | | | | | | |
| Example 2 | P1 | 100 | E1 | 5 | — | — | — | — | — | — | 3 | 4 | 4 |
| | | | B1 | 30 | | | | | | | | | |
| Example 3 | P1 | 100 | E1 | 9 | — | — | — | — | — | — | 3 | 4 | 4 |
| | | | B1 | 26 | | | | | | | | | |
| Example 4 | P1 | 100 | E1 | 12 | — | — | — | — | — | — | 3 | 4 | 4 |
| | | | B1 | 23 | | | | | | | | | |
| Example 5 | P1 | 100 | E1 | 5 | — | — | — | — | — | — | 3 | 4 | 4 |
| | | | B2 | 30 | | | | | | | | | |
| Example 6 | P1 | 100 | E1 | 5 | — | — | — | — | — | — | 3 | 4 | 3 |
| | | | B3 | 30 | | | | | | | | | |
| Example 7 | P1 | 100 | E1 | 5 | — | — | — | — | — | — | 3 | 4 | 4 |
| | | | B4 | 30 | | | | | | | | | |
| Example 8 | P1 | 100 | E1 | 5 | A1 | 20 | — | — | — | — | 4 | 4 | 4 |
| | | | B1 | 30 | | | | | | | | | |
| Example 9 | P1 | 100 | E1 | 5 | A1 | 20 | — | — | — | — | 4 | 4 | 4 |
| | | | B2 | 30 | | | | | | | | | |
| Example 10 | P1 | 100 | E1 | 5 | A1 | 20 | — | — | — | — | 4 | 4 | 4 |
| | | | B4 | 30 | | | | | | | | | |
| Example 11 | P1 | 100 | E2 | 5 | A1 | 20 | — | — | — | — | 3 | 4 | 3 |
| | | | B1 | 30 | | | | | | | | | |
| Example 12 | P1 | 100 | E3 | 5 | A1 | 20 | — | — | — | — | 3 | 4 | 3 |
| | | | B1 | 30 | | | | | | | | | |
| Example 13 | P1 | 100 | E4 | 5 | A1 | 20 | — | — | — | — | 4 | 3 | 3 |
| | | | B1 | 30 | | | | | | | | | |
| Example 14 | P1 | 100 | E5 | 5 | A1 | 20 | — | — | — | — | 4 | 4 | 4 |
| | | | B1 | 30 | | | | | | | | | |
| Example 15 | P1 | 100 | E6 | 5 | A1 | 20 | — | — | — | — | 4 | 3 | 4 |
| | | | B1 | 30 | | | | | | | | | |
| Example 16 | P1 | 100 | E7 | 5 | A1 | 20 | — | — | — | — | 4 | 4 | 4 |
| | | | B1 | 30 | | | | | | | | | |
| Example 17 | P1 | 100 | E8 | 5 | A1 | 20 | — | — | — | — | 3 | 4 | 3 |
| | | | B1 | 30 | | | | | | | | | |
| Example 18 | P1 | 80 | E1 | 5 | — | — | — | — | — | — | 3 | 4 | 3 |
| | P2 | 20 | B1 | 30 | | | | | | | | | |
| Example 19 | P1 | 80 | E1 | 5 | — | — | — | — | — | — | 3 | 3 | 4 |
| | P3 | 20 | B1 | 30 | | | | | | | | | |
| Example 20 | P1 | 60 | E1 | 5 | — | — | — | — | — | — | 3 | 3 | 3 |
| | P3 | 40 | B1 | 30 | | | | | | | | | |
| Example 21 | P1 | 100 | E1 | 5 | A1 | 20 | P2 | 100 | B3 | 20 | 4 | 4 | 4 |
| | | | B2 | 30 | | | | | | | | | |
| Example 22 | P1 | 100 | E5 | 5 | — | — | P2 | 100 | B3 | 20 | 3 | 4 | 4 |
| | | | B2 | 30 | | | | | | | | | |
| Example 23 | P1 | 100 | E7 | 5 | — | — | P2 | 100 | B3 | 20 | 3 | 4 | 4 |
| | | | B2 | 30 | | | | | | | | | |
| Comparative Example 1 | P1 | 100 | E1 | 35 | — | — | — | — | — | — | 2 | 3 | 4 |

TABLE 1-continued

| | Outermost coating layer | | | | | | Coating layer | | | | | | |
|---|---|---|---|---|---|---|---|---|---|---|---|---|---|
| | Pigment | | Binder | | Additives | | Pigment | | Binder | | Image | Color | |
| | Type | Parts by mass | Type | Parts by mass | Type | Parts by mass | Type | Parts by mass | Type | Parts by mass | deterioration resistance | development property | Adhesion property |
| Comparative Example 2 | P1 | 100 | B3 | 35 | — | — | — | — | — | — | 2 | 4 | 3 |
| Comparative Example 3 | P1 | 100 | B4 | 35 | — | — | — | — | — | — | 3 | 2 | 1 |
| Comparative Example 4 | P2 | 100 | E1<br>B1 | 5<br>30 | — | — | — | — | — | — | 2 | 3 | 2 |
| Comparative Example 5 | P3 | 100 | E1<br>B1 | 5<br>30 | — | — | — | — | — | — | 1 | 3 | 3 |
| Comparative Example 6 | P1 | 100 | B4 | 35 | — | — | P2 | 100 | E1<br>B3 | 5<br>30 | 3 | 2 | 2 |

From the results of Table 1, it can be seen that Examples 1 to 23 corresponding to the present invention have good image deterioration resistance, color development property and adhesion property. It can be seen that Comparative Examples 1 to 6 that do not satisfy the constitution of the present invention cannot simultaneously satisfy all of the effects according to the present invention.

Mainly, the comparison between Examples 8, 14 and 16 and Examples 11, 12, 13 and 17 shows that the glass transition temperature of the ethylene-vinyl acetate copolymer is preferably more than 0° C.

Mainly, the comparison between Examples 8, 14 and 16 and Examples 13 and 15 shows that the average particle diameter of the ethylene-vinyl acetate copolymer is preferably 0.08 μm or more and 0.3 μm or less.

Examples 24 to 39

<Base Paper>

The base paper 1 was used as the base paper.

<Outermost Coating Layer-Coating Composition and Coating Layer-Coating Composition>

The following materials were blended with water as a medium and the concentration of a coating solution was adjusted to 13% by mass to prepare an outermost coating layer-coating composition and a coating layer-coating composition for providing between the outermost coating layer and the base paper. The number of blending parts is described in Table 2. The ethylene-vinyl acetate copolymer was prepared by emulsion polymerization. The symbols in Table 2 indicate the above materials as in Table 1.

<Transfer Papers of Examples 24-35 and 37-39>

The outermost coating layer-coating composition was applied on one side of the base paper 1 with an air knife coater so as to make the coating amount 9 g/m$^2$, and dried in a hot air dryer. After that, it was subjected to super calendering processing to obtain a transfer paper.

<Transfer Paper of Example 36>

The coating layer-coating composition was applied on one side of the base paper 1 with a blade coater so as to make the coating amount 5 g/m$^2$, and dried in a hot air dryer. Subsequently, the outermost coating layer-coating composition was applied on the coating layer with an air knife coater so as to make the coating amount 9 g/m$^2$, and dried in a hot air dryer. After that, it was subjected to super calendering processing to obtain a transfer paper.

<Preparation of Printed Transfer Paper>

Evaluation patterns with sublimation textile inks (cyan, magenta, yellow, black) were printed on each obtained transfer paper using an inkjet printer (JV2-130 II, manufactured by Mimaki Engineering Co., Ltd.) using the sublimation textile inks to obtain each printed transfer paper (roll paper).

<Textile Printing (Roll Paper)>

Rolled polyester cloth was used as a printing substrate. The resultant roll paper-state printed transfer paper and the polyester cloth were brought into close contact with each other, and the dye was transferred to the polyester cloth using a heating and pressing machine (200° C., 0.5 MPa, 2.0 m/min, roller type, contact time with rollers for 45 seconds). Thereafter, the printed transfer paper was peeled off from the polyester cloth to obtain a polyester cloth having a pattern formed thereon.

<Evaluation of Image Deterioration Resistance>

The same as above.

<Evaluation of Color Development Property>

The same as above.

<Evaluation of Adhesion Property>

The same as above.

<Evaluation of Resistance to Textile Printing Unevenness>

Textile printing was performed using a printed transfer paper (roll shape) which was rolled up into a roll shape after printing 50 patterns to prepare a printed printing substrate in a roll shape having 50 patterns formed thereon. About the obtained printed printing substrate, the occurrence degree of the textile printing unevenness was visually evaluated according to the following criteria.

A: Textile printing unevenness is hardly recognized, and the formed pattern is good.

B: Textile printing unevenness is slightly observed, but the formed pattern has no practical problem.

C: Textile printing unevenness is recognized, and the formed pattern becomes a practical problem.

From the result of the visual evaluation, the number of printed printing substrates corresponding to A and C was determined and evaluated according to the following criteria. In the present invention, if the evaluation is 3 or 4, the transfer paper is judged to have good resistance to textile printing unevenness.

4: The number of cases of C is less than 2, and the number of cases of A is 30 or more.

3: The number of cases of C is less than 2, and the number of cases of A is less than 30.

2: The number of cases of C is 2 or more and less than 6.

1: The number of cases of C is 6 or more.

Evaluation results are shown in Table 2.

TABLE 2

| | Outermost coating layer | | | | | | Coating layer | | | | | | | |
|---|---|---|---|---|---|---|---|---|---|---|---|---|---|---|
| | Pigment | | Binder | | Additives | | Pigment | | Binder | | Image | | | Resistance |
| | Type | Parts by mass | Type | Parts by mass | Type | Parts by mass | Type | Parts by mass | Type | Parts by mass | deterio-ration resistance | Color development property | Adhesion property | to textile printing unevenness |
| Example 24 | P1 | 100 | E1<br>B2 | 1<br>34 | — | — | — | — | — | — | 3 | 4 | 3 | 4 |
| Example 25 | P1 | 100 | E1<br>B2 | 2<br>33 | — | — | — | — | — | — | 3 | 4 | 4 | 4 |
| Example 26 | P1 | 100 | E1<br>B2 | 5<br>30 | — | — | — | — | — | — | 3 | 4 | 4 | 4 |
| Example 27 | P1 | 100 | E1<br>B2 | 12<br>23 | — | — | — | — | — | — | 3 | 4 | 4 | 4 |
| Example 28 | P1 | 100 | E1<br>B2 | 15<br>20 | — | — | — | — | — | — | 3 | 3 | 4 | 3 |
| Example 29 | P1 | 100 | E2<br>B2 | 5<br>30 | — | — | — | — | — | — | 3 | 4 | 3 | 4 |
| Example 30 | P1 | 100 | E4<br>B2 | 5<br>30 | — | — | — | — | — | — | 3 | 3 | 3 | 4 |
| Example 31 | P1 | 100 | E6<br>B2 | 5<br>30 | — | — | — | — | — | — | 3 | 3 | 4 | 4 |
| Example 32 | P1 | 100 | E1<br>B2 | 5<br>30 | A1 | 20 | — | — | — | — | 4 | 4 | 4 | 4 |
| Example 33 | P1<br>P2 | 80<br>20 | E1<br>B2 | 5<br>30 | — | — | — | — | — | — | 3 | 4 | 4 | 4 |
| Example 34 | P1<br>P3 | 80<br>20 | E1<br>B2 | 5<br>30 | — | — | — | — | — | — | 3 | 3 | 4 | 4 |
| Example 35 | P1<br>P3 | 60<br>40 | E1<br>B2 | 5<br>30 | — | — | — | — | — | — | 3 | 3 | 3 | 4 |
| Example 36 | P1 | 100 | E1<br>B2 | 5<br>30 | — | — | P2 | 100 | B3 | 20 | 3 | 4 | 4 | 4 |
| Example 37 | P1 | 100 | E1<br>B1 | 5<br>30 | — | — | — | — | — | — | 3 | 4 | 4 | 2 |
| Example 38 | P1 | 100 | E1<br>B3 | 5<br>30 | — | — | — | — | — | — | 3 | 4 | 3 | 2 |
| Example 39 | P1 | 100 | E1<br>B4 | 5<br>30 | — | — | — | — | — | — | 3 | 4 | 4 | 2 |

From Table 2, by comparing Examples 24-36 in which the outermost coating layer contains two or more different binders, and at least two of them are an ethylene-vinyl acetate copolymer and a silanol-modified polyvinyl alcohol, Example 37 in which at least two of them are an ethylene-vinyl acetate copolymer and polyvinyl alcohol, Example 38 in which at least two of them are an ethylene-vinyl acetate copolymer and a styrene-butadiene copolymer, and Example 39 in which at least two of them are an ethylene-vinyl acetate copolymer and starch, it can be seen that the transfer paper in which at least two of the binders are an ethylene-vinyl acetate copolymer and a silanol-modified polyvinyl alcohol has good resistance to textile printing unevenness.

Examples 40 to 59

<Base Paper>

(Base Paper 2)

Base paper 2 was obtained in the same manner as in the base paper 1 except that ground calcium carbonate (SHIRAISHI CALCIUM KAISHA, LTD., HYDROCARB90) was used instead of the calcined kaolin.

(Base Paper 3)

Base paper 3 was obtained in the same manner as in the base paper 1 except that the amount of the calcined kaolin was changed from 12 parts by mass to 5 parts by mass.

(Base Paper 4)

Base paper 4 was obtained in the same manner as in the base paper 1 except that the amount of the calcined kaolin was changed from 12 parts by mass to 10 parts by mass.

(Base Paper 5)

Base paper 5 was obtained in the same manner as in the base paper 1 except that the amount of the calcined kaolin was changed from 12 parts by mass to 20 parts by mass.

(Base Paper 6)

Base paper 6 was obtained in the same manner as in the base paper 1 except that the amount of the calcined kaolin was changed from 12 parts by mass to 30 parts by mass.

(Base Paper 7)

Base paper 7 was obtained in the same manner as in the base paper 1 except that the pH of the paper stock was adjusted so that the pH of the base paper to be obtained was 6.5 or more and 8 or less.

(Base Paper 8)

Base paper 8 was obtained in the same manner as in the base paper 1 except that the pH of the paper stock was adjusted so that the pH of the base paper to be obtained was 10 or more and 11 or less.

(Base Paper 9)

Base paper 9 was obtained in the same manner as in the base paper 1 except that 12 parts by mass of the calcined kaolin was changed to 10 parts by mass of calcined kaolin (BASF, Ansilex) and 2 parts by mass of ground calcium carbonate (SHIRAISHI CALCIUM KAISHA, LTD., HYDROCARB90).

(Base Paper 10)

Base paper 10 was obtained in the same manner as in the base paper 1 except that 12 parts by mass of the calcined kaolin was changed to 7.5 parts by mass of calcined kaolin (BASF, Ansilex) and 4.5 parts by mass of ground calcium carbonate (SHIRAISHI CALCIUM KAISHA, LTD., HYDROCARB90).

<Outermost Coating Layer-Coating Composition and Coating Layer-Coating Composition>

The above materials were blended with water as a medium and the concentration of a coating solution was adjusted to 13% by mass to prepare an outermost coating layer-coating composition and a coating layer-coating composition for providing between the outermost coating layer and the base paper. The number of blending parts is described in Table 3. The ethylene-vinyl acetate copolymer was prepared by emulsion polymerization. The symbols in Table 3 indicate the above materials as in Table 1.

<Transfer Papers of Examples 40-48, 50 and 52-59>

The outermost coating layer-coating composition was applied on one side of the base paper with an air knife coater so as to make the coating amount 9 g/m$^2$, and dried in a hot air dryer. After that, it was subjected to super calendering processing to obtain a transfer paper.

<Transfer Paper of Examples 49 and 51>

The coating layer-coating composition was applied on one side of the base paper with a blade coater so as to make the coating amount 5 g/m$^2$, and dried in a hot air dryer. Subsequently, the outermost coating layer-coating composition was applied on the coating layer with an air knife coater so as to make the coating amount 9 g/m$^2$, and dried in a hot air dryer. After that, it was subjected to super calendering processing to obtain a transfer paper.

<Preparation of Printed Transfer Paper>

Evaluation patterns with sublimation textile inks (cyan, magenta, yellow, black) were printed on each obtained transfer paper using an inkjet printer (JV2-130 II, manufactured by Mimaki Engineering Co., Ltd.) using the sublimation textile inks to obtain each printed transfer paper (roll paper).

<Textile Printing (Roll Paper)>

Rolled polyester cloth was used as a printing substrate. The resultant roll paper-state printed transfer paper and the polyester cloth were brought into close contact with each other, and the dye was transferred to the polyester cloth using a heating and pressing machine (200° C., 0.5 MPa, 2.0 m/min, roller type, contact time with rollers for 45 seconds). Thereafter, the printed transfer paper was peeled off from the polyester cloth to obtain a polyester cloth having a pattern formed thereon.

<Evaluation of Image Deterioration Resistance>

The same as above.

<Evaluation of Color Development Property>

The same as above.

<Evaluation of Transferability>

In the printed printing substrate on which the pattern was formed by changing the heating time at the time of adhesion, the change in color development property in 45 seconds, 60 seconds and 75 seconds was visually evaluated according to the following criteria. In the present invention, if the evaluation is 3 or 4, the transfer paper is judged to have good transferability.

4: No change.

3: There is almost no change.

2: Change is recognized between 45 seconds and 60 seconds, but there is almost no change between 60 seconds and 75 seconds.

1: Change is recognized between 45 seconds and 60 seconds and between 60 seconds and 75 seconds.

Evaluation results are shown in Table 3.

TABLE 3

| | | | Outermost coating layer | | | | | | Coating layer | | | | | | |
|---|---|---|---|---|---|---|---|---|---|---|---|---|---|---|---|
| | | | Pigment | | Binder | | Additives | | Pigment | | Binder | | Image | | |
| | Base paper | | Type | Parts by mass | Type | Parts by mass | Type | Parts by mass | Type | Parts by mass | Type | Parts by mass | deterio-ration resistance | Color development property | Transfer-ability |
| Example 40 | Base paper 1 | Acidic paper | P1 | 100 | E1<br>B2 | 10<br>20 | A1 | 20 | | | | | 4 | 4 | 4 |
| Example 41 | Base paper 3 | Acidic paper | P1 | 100 | E1<br>B2 | 10<br>20 | A1 | 20 | | | | | 3 | 4 | 3 |
| Example 42 | Base paper 4 | Acidic paper | P1 | 100 | E1<br>B2 | 10<br>20 | A1 | 20 | | | | | 4 | 4 | 4 |
| Example 43 | Base paper 5 | Acidic paper | P1 | 100 | E1<br>B2 | 10<br>20 | A1 | 20 | | | | | 4 | 4 | 4 |
| Example 44 | Base paper 6 | Acidic paper | P1 | 100 | E1<br>B2 | 10<br>20 | A1 | 20 | | | | | 3 | 4 | 3 |
| Example 45 | Base paper 7 | Neutral paper | P1 | 100 | E1<br>B2 | 10<br>20 | A1 | 20 | | | | | 4 | 4 | 3 |
| Example 46 | Base paper 8 | Alkaline paper | P1 | 100 | E1<br>B2 | 10<br>20 | A1 | 20 | | | | | 4 | 4 | 3 |
| Example 47 | Base paper 9 | Acidic paper | P1 | 100 | E1<br>B2 | 10<br>20 | A1 | 20 | | | | | 4 | 4 | 4 |
| Example 48 | Base paper 10 | Acidic paper | P1 | 100 | E1<br>B2 | 10<br>20 | A1 | 20 | | | | | 3 | 4 | 3 |
| Example 49 | Base paper 1 | Acidic paper | P1 | 100 | E1<br>B2 | 10<br>20 | A1 | 20 | P2 | 100 | B3 | 20 | 4 | 4 | 4 |
| Example 50 | Base paper 2 | Acidic paper | P1 | 100 | E1<br>B2 | 10<br>20 | A1 | 20 | | | | | 3 | 3 | 2 |
| Example 51 | Base paper 2 | Acidic paper | P1 | 100 | E1<br>B2 | 10<br>20 | A1 | 20 | P2 | 100 | B3 | 20 | 3 | 3 | 2 |
| Example 52 | Base paper 1 | Acidic paper | P1 | 100 | E1<br>B2 | 10<br>20 | — | — | | | | | 3 | 4 | 4 |
| Example 53 | Base paper 1 | Acidic paper | P1 | 100 | E2<br>B2 | 10<br>20 | — | — | | | | | 3 | 4 | 4 |
| Example 54 | Base paper 1 | Acidic paper | P1 | 100 | E4<br>B2 | 10<br>20 | — | — | | | | | 3 | 3 | 4 |

TABLE 3-continued

| | Base paper | | Outermost coating layer | | | | | | Coating layer | | | | Image | | |
|---|---|---|---|---|---|---|---|---|---|---|---|---|---|---|---|
| | | | Pigment | | Binder | | Additives | | Pigment | | Binder | | | | |
| | | | Type | Parts by mass | Type | Parts by mass | Type | Parts by mass | Type | Parts by mass | Type | Parts by mass | deterio-ration resistance | Color development property | Transfer-ability |
| Example 55 | Base paper 1 | Acidic paper | P1 | 100 | E6<br>B2 | 10<br>20 | — | — | | | | | 3 | 3 | 4 |
| Example 56 | Base paper 1 | Acidic paper | P1 | 100 | E1<br>B1 | 10<br>20 | A1 | 20 | | | | | 4 | 4 | 4 |
| Example 57 | Base paper 1 | Acidic paper | P1 | 100 | E2<br>B1 | 10<br>20 | A1 | 20 | | | | | 3 | 4 | 4 |
| Example 58 | Base paper 1 | Acidic paper | P1 | 100 | E4<br>B1 | 10<br>20 | A1 | 20 | | | | | 4 | 3 | 4 |
| Example 59 | Base paper 1 | Acidic paper | P1 | 100 | E6<br>B1 | 10<br>20 | A1 | 20 | | | | | 4 | 3 | 4 |

From Table 3, by comparing Examples 40-49 and 52-59, in which at least one of the filler contained in the base paper is calcined kaolin, and Examples 50 and 51 in which the filler contained in the base paper is ground calcium carbonate, it can be seen that the transfer paper in which at least one of the filler contained in the base paper is calcined kaolin has good transferability.

Further, mainly from the comparison between Example 40, Example 45, and Example 46, it is understood that the base paper is preferably acidic paper.

The invention claimed is:

1. A transfer paper for use in a transfer textile printing method using sublimation textile ink, which comprises a base paper and one or more coating layer(s) provided on at least one side of the base paper, wherein, an outermost coating layer positioned on the outermost side with respect to the base paper contains at least a pigment and a binder, at least one of the pigment is amorphous silica, the binder contains two or more different binders, and at least one of the binders is an ethylene-vinyl acetate copolymer, and the base paper contains a filler, and at least one of the filler is calcined kaolin, a content of the calcined kaolin in the base paper is 10 parts by mass or more and 20 parts by mass or less based on 100 parts by mass of pulp in the base paper.

2. A transfer paper for use in a transfer textile printing method using sublimation textile ink, which comprises a base paper and one or more coating layer(s) provided on at least one side of the base paper, wherein, an outermost coating layer positioned on the outermost side with respect to the base paper contains at least one pigment and two or more different binders, the at least one pigment contains amorphous silica, and the two or more different binders contain an ethylene-vinyl acetate copolymer, and the base paper contains at least one filler, and the at least one filler is calcined kaolin, a content of the calcined kaolin in the base paper is 10 parts by mass or more and 20 parts by mass or less based on 100 parts by mass of pulp in the base paper.

3. The transfer paper according to claim 1, wherein a glass transition temperature of the ethylene-vinyl acetate copolymer is more than 0° C.

4. The transfer paper according to claim 1, wherein the ethylene-vinyl acetate copolymer has an average particle diameter of 0.08 μm or more and 0.3 μm or less.

5. The transfer paper according to claim 1, wherein the binder contains two or more different binders, at least two of which are an ethylene-vinyl acetate copolymer and a silanol-modified polyvinyl alcohol.

6. The transfer paper according to claim 2, wherein the two or more different binders contain an ethylene-vinyl acetate copolymer and a silanol-modified polyvinyl alcohol.

7. The transfer paper according to claim 1, wherein the base paper is an acidic paper.

8. The transfer paper according to claim 2, wherein a glass transition temperature of the ethylene-vinyl acetate copolymer is more than 0° C.

9. The transfer paper according to claim 2, wherein the ethylene-vinyl acetate copolymer has an average particle diameter of 0.08 μm or more and 0.3 μm or less.

10. The transfer paper according to claim 2, wherein the base paper is an acidic paper.

11. The transfer paper according to claim 3, wherein the binder contains two or more different binders, at least two of which are an ethylene-vinyl acetate copolymer and a silanol-modified polyvinyl alcohol.

12. The transfer paper according to claim 8, wherein the two or more different binders contain an ethylene-vinyl acetate copolymer and a silanol-modified polyvinyl alcohol.

* * * * *